United States Patent [19]

Stepe

[11] 4,043,060

[45] Aug. 23, 1977

[54] COMBINATION STRENGTHENED LOADER BUCKET AND REPLACEABLE CUTTING EDGE

[75] Inventor: Visvaldis A. Stepe, Willow Springs, Ill.

[73] Assignee: Caterpillar Tractor Co., Peoria, Ill.

[21] Appl. No.: 718,734

[22] Filed: Aug. 30, 1976

[51] Int. Cl.[2] ..... E02F 9/28

[52] U.S. Cl. ..... 37/141 R; 37/117.5; 37/DIG. 12

[58] Field of Search ..... 37/141 R, 141 T, 142 R, 37/142 A, 118 R, 118 A, DIG. 12, 117.5; 172/753, 777, 713, 719; 214/145 R, 145 A

[56] References Cited

U.S. PATENT DOCUMENTS

| | | | |
|---|---|---|---|
| 872,439 | 12/1907 | Livengood | 37/141 R |
| 995,285 | 6/1911 | Pemberton | 37/142 R |
| 1,772,624 | 8/1930 | Brendlin | 37/141 R |
| 1,963,847 | 6/1934 | Jersey | 37/141 R |
| 2,597,374 | 5/1952 | Richey | 214/145 R |
| 2,612,280 | 9/1952 | Stueland | 37/142 R X |
| 3,160,967 | 12/1964 | Nichols | 37/141 R |
| 3,281,972 | 11/1966 | Kerestes | 37/141 R |
| 3,469,330 | 9/1969 | Hood et al. | 37/141 R X |
| 3,550,293 | 12/1970 | Helton | 37/141 R |
| 3,685,177 | 8/1972 | Hahn et al. | 37/141 R |
| 3,706,388 | 12/1972 | Westendorf | 37/142 R X |
| 3,765,109 | 10/1973 | Daviduke | 37/141 R |
| 3,984,929 | 10/1976 | Meyer et al. | 37/141 R |

*Primary Examiner*—Clifford D. Crowder
*Attorney, Agent, or Firm*—Charles E. Lanchantin, Jr.

[57] ABSTRACT

A strengthened loader bucket and a replaceable cutting edge includes a bucket shell having a floor with at least two strengthening members weldably secured to the upper surface of the floor in longitudinally extending and laterally spaced apart relation and individually having a nose portion thereon. The replaceable cutting edge includes a blade with at least two housing elements weldably secured to an upper surface thereof which provides therewith at least two sockets that are individually adapted to receive the nose portions of the strengthening members interlockingly therein and being so constructed and arranged that the blade is generally coplanar with the floor.

5 Claims, 4 Drawing Figures

COMBINATION STRENGTHENED LOADER BUCKET AND REPLACEABLE CUTTING EDGE

BACKGROUND OF THE INVENTION

This invention relates to a work implement, such as a loader bucket, having a shell and a pair of strengthening members to which may be quickly secured various cutting edges adapted for either clean up operations or more aggressive penetrating type operations.

A conventional loader bucket usually includes a laterally extending cutting edge which is weldably secured to the floor thereof for performing various clean up and earthmoving operations. However, these integral cutting edges wear out and the machine down time and cost for replacing them is substantial since a cutting torch and welding equipment are required.

In certain work applications where a more aggressive type of bucket is desired, a plurality of adapters are secured to the cutting edge of the bucket so that hardened and replaceable wear tips can be mounted on the forward ends thereof. In the past, the large majority of such adapters have been of bifurcated construction to enable them to straddle the cutting edge and to prevent their dislodgement upon being exposed to high working forces. Unfortunately, these adapters extend below the bucket floor considerably so that as the bucket travels forwardly in a normal working attitude, deep and unsightly ruts are formed in the earth.

Thus, it may be appreciated that loader buckets are used for a variety of jobs. On some occasions they are used for clean up operations wherein a relatively flat lower surface is preferred, whereas at other times increased penetration is desired which requires that various adapter teeth and tip combinations be employed with the cutting edge. Heretofore, however, it has not been practical to convert the bucket from one mode of operation to another because of the service difficulty and expense involved. For example, it is difficult to remove the usual large number of bolts after they have experienced rusting and wear.

Still another problem is that of directing high working forces rearwardly through the bucket with conventionally bolted on and replaceable cutting edges. For the most part the conventionally attached edges have been mounted on the bucket in such a way that working forces are transferred rearwardly into the floor of the bucket shell. Since the shell is usually thin, it lacks rigidity and distortion and cracking thereof frequently occurs. Moreover, as the cutting edge gets worn its beam strength is reduced and the thin bucket floor and cutting edge deform to a bowed or concave shape. With such permanent deflection it becomes difficult to make level cuts in the earth.

SUMMARY AND OBJECTS OF THE INVENTION

Accordingly, it is an object of the present invention to provide a strengthened loader bucket which is better able to allow the convenient replacement of different cutting edges across the forward longitudinal edge thereof.

Another object of the invention is to provide such a loader bucket which can be quickly converted from a passive, clean-up type operation to an aggressive, earth or rock penetrating type operation by utilizing a minimum number of relatively simple fastening devices between the bucket and the cutting edges.

Another object of the invention is to provide a loader bucket of the character described that is better adapted to primarily transfer loads from the replaceable cutting edge rearwardly back through rugged structural members thereof, rather than through its shell.

Other objects and advantages of the present invention will become more readily apparent upon reference to the accompanying drawings and the following description.

DESCRIPTION OF THE PREFERRED EMBODIMENT

Figure 1:
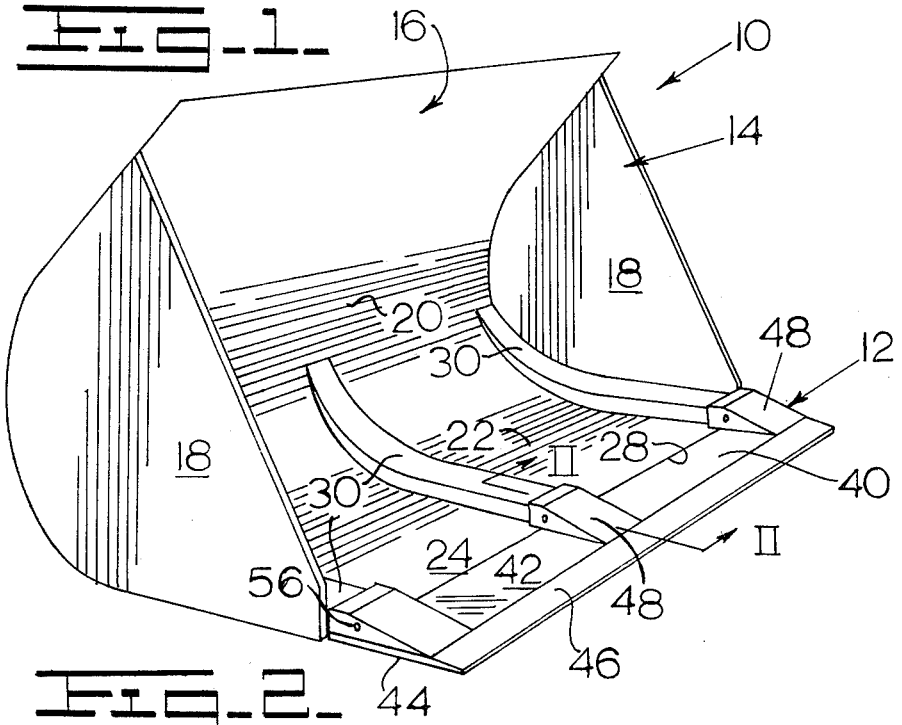
FIG. 1 is an oblique front perspective view of a strengthened loader bucket and a replaceable cutting edge constructed in accordance with the present invention.
Figure 2:
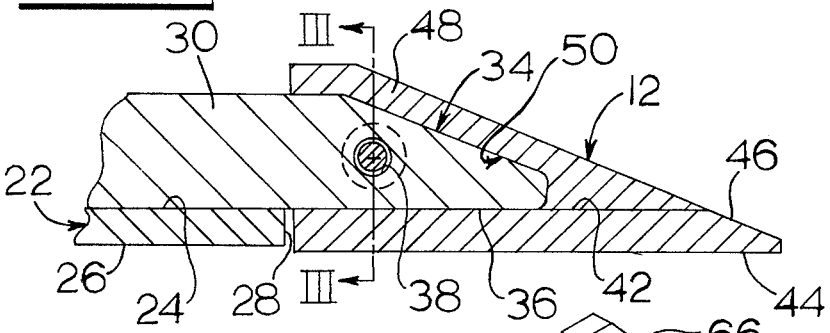
FIG. 2 is a fragmentary longitudinal sectional view taken along the line II—II in FIG. 1.

Referring now to FIGS. 1 and 2, a strengthened loader bucket 10 is disclosed which is adapted to receive a replaceable cutting edge 12 in accordance with the present invention. The loader bucket includes a bucket shell 14 constructed generally of an arcuately profiled wall or body portion 16 and a pair of opposite side walls 18 integrally welded thereto in the usual manner. More particularly, the profiled wall includes a curved back wall 20, and a floor 22 extending forwardly therefrom having an upper surface 24, a bottom surface 26, and a leading edge 28 extending laterally across the front thereof.

In accordance with one aspect of the invention, at least two strengthening members or beams 30 are integrally secured to the upper surface 24 of the bucket shell 14 in longitudinally extending and laterally spaced apart relation. These solid beams taper convergingly rearwardly and extend approximately half way up the back wall 20 as illustrated, and are individually weldably secured into the corners of the bucket at the intersection of the profiled wall 16 and the side walls 18 for rigidity of construction. Preferably, one or more beams of identical construction are symmetrically spaced between them, as represented by the laterally centered beam shown, in order to more directly transmit centrally applied working forces on the cutting edge rearwardly to the back wall of the bucket and to reduce bucket floor deflection or bowing.

Referring now to FIG. 2, each of the beams 30 advantageously has a forwardly converging nose portion 34 thereon which extends forwardly in overhanging relation beyond the leading edge 28 of the bucket floor 22. In such condition a lower surface 36 of the nose portion is substantially coplanar with the upper surface 24 of the floor. Furthermore, a pin-receiving bore 38 is defined transversely through each nose portion and a lock-receiving counterbore 39 opens outwardly therefrom concentrically at one end thereof.

In accordance with one aspect of the invention, the replaceable cutting edge 12 may be quickly mounted solely on the nose portions 34 of the beams 30. This cutting edge includes a flat cutting blade 40 having an upper surface 42, a lower surface 44, and a shaped penetrating edge 46. Moreover, a wedge-shaped channel or housing element 48 having a generally inverted U-shaped transverse cross section is integrally secured to the upper surface of the blade at a number of individually longitudinally aligned locations corresponding to each one of the beams. Thus, each housing defines with the blade a tapered socket 50 of a profile adapted to tightly receive the individual nose portions of the beams.

Figure 3:
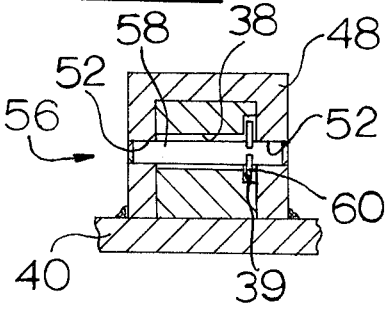
FIG. 3 is a fragmentary transverse sectional view taken along the line III—III in FIG. 2.

As shown best in FIG. 3, the individual housing elements 48 have an opposite pair of aligned apertures 52 therethrough. This permits a quick-release retainer arrangement 56 to be defined between each of the housing elements and the nose portions 34 of the beams 30. Such arrangement further includes a cylindrical steel retaining pin 58 which is insertably installed conveniently within the pin-receiving bore 38 in the beam and within the apertures 52. The pin is positively retained in place by a split spring ring or lock 60 which is seatably disposed in the beam counterbore 39 and is peripherally grippingly mounted on the pin.

OPERATION

While the operation of the present invention is believed clearly apparent from the foregoing description, further amplification will subsequently be made in the following brief summary of such operation. During forward movement of the bucket 10 and the cutting edge 12 penetrating through the earth, working forces are transmitted rearwardly from the blade 40 and the spaced housing elements 48 to the interlocking nose portions 34 of the beams 30. Thus, pursuant to the present invention, high forces are transmitted to the beams directly through the tapered sockets 50 and thence directly rearwardly to the back wall 20 of the bucket. This is achieved without any significant degree of loading of the quick-release retainer arrangements 56 and with but minor force transmission through the forward part of the floor 22. In this regard it is noted that the blade does not directly contact the floor.

In accordance with one aspect of the invention, the beams 30 are disposed elevationally above the upper surface 24 of the floor 22 so that the cutting blade and floor can be substantially coplanar and also to reduce wear of the beam. In the instant example the lower surface 44 of the blade depends downwardly a slight amount below the bottom surface 26 of the floor in order to provide additional wear material thereat and to protect the shell 14 during the normal working conditions. Nevertheless, it is apparent that this coplanar characteristic allows the cutting edge 12 to be used for non-aggressive or fine clean up work wherein a smooth lower surface for low resistance to sliding is desired. From the foregoing it is also to be appreciated that in order to replace the cutting edge 12 after it is worn, it is only necessary for a mechanic to disengage the three quick-release retainer arrangements 56 illustrated in the instant example. This is accomplished by driving the individual pins 58 laterally outwardly of the housing elements 48 with a hammer and drive pin or the like. This contrasts with prior art constructions requiring time-consuming screw threaded disengagement of a large number of retaining bolts.

REPLACEMENT OF AGGRESSIVE CUTTING EDGE

Figure 4:
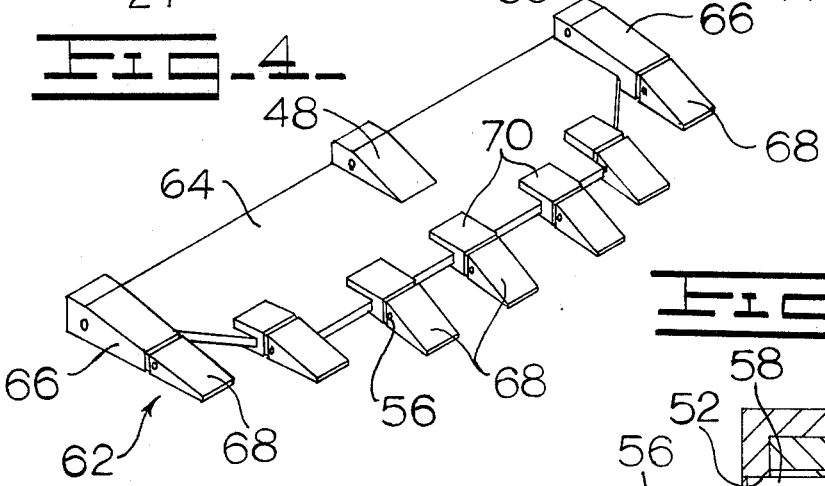
FIG. 4 is an oblique front perspective view of a replacement aggressive cutting edge which is adapted to be removably secured to the loader bucket of FIG. 1.

Upon removal of the cutting edge 12, it may be appreciated that a more aggressive cutting edge 62 can be installed in its place such as is illustrated in FIG. 4. Such aggressive cutting edge includes a rock penetrating blade 64 and a centrally disposed housing element 48 identical to that described above. On the opposite sides of the blade, however, are a pair of adapter elements 66 having tapered sockets 50 defined therein corresponding to those described earlier so that the new blade may be mounted on the front ends of the beams 30 substantially as described above. Each of these adapter elements is further constructed to receive a replaceable wear tip 68 which is positively secured thereto by a retainer arrangement like that of FIG. 3. A plurality of bifurcated adapters 70 are secured to the front of the blade, and are similarly constructed to individually receive one of the wear tips 68 thereon.

Thus, it is clearly apparent that the more rugged construction of the rock penetrating blade 64, the adapter element 66, the adapters 70, and the wear tips 68 provides for a more aggressive bucket 10 which is useful in rock and difficult digging applications. Even though heavier forces might be encountered, such forces are still desirably directly rearwardly through the beams 30, and not directly to the front of the bucket shell 14. Furthermore, such construction is beneficial because it eliminates the need for a variety of wear members to be secured to the bottom of the bucket.

While the invention has been described and shown with particular reference to a preferred embodiment, it will be apparent that variations might be possible that would fall within the scope of the present invention, which is not intended to be limited except as defined in the following claims.

What is claimed is:

1. A combination strengthened loader bucket and replaceable cutting edge comprising:

a bucket shell including a floor having an upper surface, a lower surface, and a leading edge;

at least two strengthening members weldably secured to said upper surface of the floor in longitudinally extending and laterally spaced apart relation and individually having a nose portion thereon, said nose portions extending forwardly of said leading edge and being elevationally disposed fully above said upper surface of the floor; and a replaceable cutting edge having a blade with an upper surface and a lower surface and including at least two housing elements weldably secured to said upper surface of the blade and providing therewith at least two sockets individually adapted to receive said nose portions of said strengthening members interlockingly therein and so constructed and arranged that said upper and lower surfaces of the blade are generally coplanar respectively with said upper and lower surfaces of the floor.

2. The combination of claim 1 wherein working forces of said cutting edge are transmitted solely through said nose portions.

3. The combination of claim 2 including quick-release retaining means transversely disposed between each of said nose portions and said housing elements for positively securing said cutting edge to said loader bucket.

4. A combination strengthened loader bucket and replaceable cutting edge comprising:

a bucket shell including a floor having an upper surface and a leading edge;

at least two strengthening members weldably secured to said upper surface of the floor in longitudinally extending and laterally spaced apart relation and individually having a nose portion thereon, said nose portions extending forwardly of said leading edge and being elevationally disposed fully above said upper surface of the floor; and a replaceable cutting edge having a blade with an upper surface and including at least two housing elements weldably secured to said upper surface of the blade and providing therewith at least two sockets individually adapted to receive said nose portions of said strengthening members interlockingly therein and so constructed and arranged that said upper surface of the blade is disposed immediately adjacent and fully forwardly of said leading edge of the floor with said upper surfaces of the blade and the floor arranged in a common plane.

5. The combination of claim 4 wherein said nose portions of the strengthening members are convergingly tapered, and said housing elements are inverted wedge-shaped channels which define with the blade tapered sockets receiving said nose portions and transferring working forces solely thereto.

* * * * *